United States Patent [19]

Remberg

[11] Patent Number: 4,744,726

[45] Date of Patent: May 17, 1988

[54] TURBOSET WITH AT LEAST ONE LOW-PRESSURE TURBINE STAGE HAVING AN OUTER HOUSING AND AN INNER HOUSING COAXIAL THERETO, AND WITH HIGH-PRESSURE AND/OR MEDIUM-PRESSURE TURBINE STAGE

[75] Inventor: Axel Remberg, Mülheim, Fed. Rep. of Germany

[73] Assignee: Kraftwerk Union Aktiengesellschaft, Mülheim, Fed. Rep. of Germany

[21] Appl. No.: 879,008

[22] Filed: Jun. 26, 1986

[30] Foreign Application Priority Data

Jun. 27, 1985 [DE] Fed. Rep. of Germany ..... 3522916

[51] Int. Cl.[4] ..... F01D 25/24

[52] U.S. Cl. ..... 415/219 R

[58] Field of Search ..... 415/219 R, 104, 134

[56] References Cited

U.S. PATENT DOCUMENTS

| | | | |
|---|---|---|---|
| 3,630,635 | 12/1971 | Fatum | 415/219 R |
| 3,881,843 | 5/1975 | Meylan | 415/219 R |
| 4,027,998 | 6/1977 | Schwartz | 415/219 R |
| 4,102,598 | 7/1978 | Stock et al. | 415/219 R |

FOREIGN PATENT DOCUMENTS

| | | | |
|---|---|---|---|
| 1216322 | 5/1966 | Fed. Rep. of Germany . | |
| 2655322 | 6/1978 | Fed. Rep. of Germany | 415/219 R |
| 2717617 | 9/1978 | Fed. Rep. of Germany | 415/219 R |
| 1332074 | 6/1963 | France . | |
| 1145612 | 3/1969 | United Kingdom . | |

OTHER PUBLICATIONS

VGB Kraftwerkstechnik 53, No. 12, Dec. 1973, pp. 817–843.

*Primary Examiner*—Robert E. Garrett
*Assistant Examiner*—John T. Kwon
*Attorney, Agent, or Firm*—Herbert L. Lerner; Laurence A. Greenberg

[57] ABSTRACT

Turboset includes a horizontal, heat-movable lug mounting of an inner housing of the respective low-pressure turbine stage on lug arms structurally combined with a vacuumtight leadthrough of coupling rods via which the thrust transmission is disposable in vicinity of the thrust transmitting turbine mounts; the lug arms of the inner housing of the respective low-pressure turbine stage extending in a direction parallel to a shaft center line, and sliding support and guide surfaces of the lug arms being mounted and guided on fixed bearing surfaces of an associated mount housing; the coupling rods being positively coupled to the lug arms in the vicinity of the thrust transmitting turbine mounts, and the leadthrough through the outer housing of the respective low-pressure turbine stage for the positive-coupled coupling rod to the respective lug arm being disposed on the support and guide surfaces of the fixed bearing surfaces, respectively, in a common vacuum chamber communicating with an exhaust steam chamber of the low-pressure turbine stage and, respectively, sealed from the outside by a diaphragm seal.

18 Claims, 16 Drawing Sheets

| FIG 1A | FIG 1B |
|---|---|

| FIG 2A | FIG 2B |
|---|---|

TURBOSET WITH AT LEAST ONE LOW-PRESSURE TURBINE STAGE HAVING AN OUTER HOUSING AND AN INNER HOUSING COAXIAL THERETO, AND WITH HIGH-PRESSURE AND/OR MEDIUM-PRESSURE TURBINE STAGE

The invention relates to a turboset with at least one low-pressure turbine stage having an outer housing and an inner housing coaxial therewith, and with at least one other high-pressure and/or medium-pressure turbine stage disposed coaxially with and upstream of the low-pressure turbine stage, the shafts of the turbine stages being rigidly coupled to each other to form a through-shaft.

Mounting the inner housing or housings of the respective low-pressure turbine stage (n) in its outer housing, especially with support lugs in the area of the axial housing parting line, with the outer housing mounted separately by support lugs of its own on foundation cross locks or indirectly via the exhaust steam stub or union connected thereto, will economize on the need for a sealing system for the inner housing mount by means of compensators as described, for example, in U.S. Pat. No. 3,881,843. The axial plays between mutually adjacent rows of rotor blades and guide vanes, however, become relatively greater with increasing size and capacity of the turboset and with increasing spacing of axially normal reference planes for the shifting of shaft and housing because the axial expansion of the through shaft over its length, calculated from its reference plane in +x direction (as viewed downstream) or −x direction (as viewed upstream) must be related to the axial expansion of the housings of the individual turbine stages and, in particular, to the axial expansion of the inner housing of the individual low pressure turbine stages over the axial expansion length thereof. Known from German Published Prosecuted Application (DE-AS) No. 1 216 322 is a steam or gas turbine with the important features mentioned hereinbefore, although no information or only inferred information is given therein regarding the mounting of the housings of the low-pressure turbine stages and of the medium-pressure turbine stage, and, for the proposed solution of the posed problems, the inner housing of the low-pressure turbine stage (n) is axially movable relative to the outer housing and coupled to the adjacent housing of a medium-pressure turbine stage or to a bearing block by means of a linkage led steam tightly and movably through the outer housing wall. Serving as a sealing element to seal the leadthrough, in particular, is an axially and radially flexible bellows fastened vacuum-tightly to a collar of the coupling rod, on the one hand, and to the outer housing, on the other hand. Therefore, it is stressed by relatively great movements. Sealing may also be accomplished by means of a sliding fit, but this is never quite vacuumtight or else requires very precise machining.

Regarding the housing and shaft mounting of a steam turbine according to the essential features known in the state of the art, further details may be obtained from the journal VGB-Kraftwerkstechnik 53, No. 12 of December 1973, pages 817/26, and especially pages 820 and 822. The turbine type A therein has an axially normal reference plane for the axial housing expansion, that plane transacting a turbine bearing between the medium-pressure and the low-pressure turbine stages. This determines the fixed point of the housing expansion for the inner housings of the low-pressure turbine stages in the +x direction and for the connected housings of the medium-pressure and high-pressure turbine stages in the −x direction. While the bearing blocks or bearing housings of the high-pressure and medium-pressure turbine stages are each stationary, the axial or thrust bearing of the turbine shaft is movable, its housing being connected to the high-pressure turbine stage housing by two horizontal push rods, thus following the latter's movement. In the literature cited, the coupling or push rods for the axial motion of the inner housings of the low-pressure turbine stages are merely indicated, the turbine mounts for the inner housing are neither shown nor described, the same is in German Published Prosecuted Application (DE-AS) No. 1 216 322. It is emphasized, however, that the heretofore known turbine type A permits good compensation of the thermal axial rotor and housing expansions occurring in operation, especially in the ND section (low-pressure section) of the turbine.

This general posing of the problems also underlies the invention of the instant application; it can be defined in that the axial shaft and housing shifting in a turboset, in general, and in a steam turbine, in particular, is to take place over an expansion length as uniformly as possible and in the same direction while achieving minimum axial plays between mutually adjacent rotor blade and vane rings, especially as far as the rotor blade and vane rings of the low-pressure turbine stages are concerned. Starting therefrom, the invention is based on constructing the turboset of the aforedescribed general type so that the fewest sealed leadthroughs for the coupling rods and the support lugs and for the mounting element of the inner housings of the low-pressure turbine stages interacting therewith, respectively, are required, and the stress on the sealing elements can be reduced. Secondary problems, the solution of which is to be made possible by further developments of the subject of the invention are formed primarily in that, due to the new construction, the possibility is providing of placing the leadthroughs for the coupling rods in readily accessible locations so as to assure easy assembly and replacement of the sealing elements; the normal-to-the-axis reference planes from which the axial housing expansion starts are able to be so placed as to provide simple and uncluttered conditions during bearing adjustments and during operation, and so that the first axially normal reference plane also defines a fixed point for the axial shaft expansion, and the turboset is so constructed that the sealing elements can be used also for those leadthrough locations related to the axially centered guidance of the respective inner housing or of the coupling-rodless mounting of the latter.

It is therefore an object of the invention to provide such a turboset which avoids the foregoing problems.

With the foregoing and other objects in view, there is provided in accordance with the invention a turboset having at least one low-pressure turbine stage with an outer housing and an inner housing coaxial therewith, and having at least one other high-pressure and/or medium-pressure turbine stage disposed coaxially with and upstream of the low-pressure turbine stage, the turbine stages having shafts rigidly coupled to one another to form a line of shafts, turbine stages having respective housings which with the shaft line are mounted in turbine mounts formed of housing mounts and shaft bearings, the turbine mounts located between the turbine stages having housing mounts mounted on foundation locks of a turbine foundation in axial interspaces between the turbine stages and at ends of the turbine stages, and a turbine mount with a thrust bearing for the shaft line preceding the low-pressure turbine stage upstream therefrom, the thrust bearing of the last-mentioned turbine mount defining an axially normal first reference plane $(y\text{-}z)_0$ from which axial shaft expansion and shift take their start, the low-pressure turbine stage having an outer housing, and an inner housing mounted so as to be radially-centrically, heat-movable and axially shiftable independently of and relative to the outer housing and being also connected to an axially movably mounted end of an axially adjacent turbine stage housing or turbine mount housing by means of thrust transmitting coupling rods leading heat-movably and vacuumtightly through an end wall of the outer housing by means of sealing elements also permitting limited transverse motion, and one of the turbine mounts preceding the low-pressure turbine stage defining an axially normal second reference plane $(y\text{-}z)_1$ from which axial expansion and shift of the turbine stage housing mounted on the one turbine mount and of the turbine stage housings coupled thereto, including the inner housing or housings of the low-pressure turbine stage or stages, take their start so that the shaft and housing shift takes place over practically the same axial expansion length and in the same direction while achieving minimum axial plays between mutually adjacent rotor blade and vane rings of the respective low-pressure turbine stage, includes a horizontal, heat-movable lug mounting of the inner housing of the respective low-pressure turbine stage on lug arms structurally combined with the vacuumtight leadthrough of the coupling rods via which the thrust transmission is disposable in vicinity of the thrust transmitting turbine mounts; the lug arms of the inner housing of the respective low-pressure turbine stage extending in a direction parallel to the shaft center line, and sliding support and guide surfaces of the lug arms being mounted and guided on fixed bearing surfaces of the associated mount housing; the coupling rods being positively coupled to the lug arms in the vicinity of the thrust transmitting turbine mounts, and the leadthrough through the outer housing of the respective low-pressure turbine stage for the positive-coupled coupling rod to the respective lug arm being disposed on the support and guide surfaces of the fixed bearing surfaces, respectively, in a common vacuum chamber communicating with an exhaust steam chamber of the low-pressure turbine stage and, respectively, sealed from the outside by means of a diaphragm seal.

In accordance with another feature of the invention, an outer ring flange of the diaphragm seal for the vacuumtight leadthrough is attached vacuumtightly to an end face of the outer housing of the low-pressure turbine stage, and an inner ring flange is attached vacuumtightly to a turbine mount housing part which accommodates in the interior thereof at least most of the respective coupling rod and forms a part of the vacuum chamber.

In accordance with a further feature of the invention, the inner housings of the low-pressure turbine stages are split axially and lower parts thereof have at the ends, respectively, two of the lug arms projecting out on both sides of a vertical axial plane (x-y) symmetrically and in a direction parallel to the shaft center line, the lug arms being disposed in vicinity of an axial parting line and in vicinity of the largest inner housing diameter.

In accordance with an additional feature of the invention, the fixed bearing surfaces are formed by stationary consoles of the mount housings anchored in the foundation locks, support arms of the consoles extending out in line with the lug arms towards the lug arms through the respective outer housing end wall, the support and guide surfaces being disposed on the top and bottom sides of supporting extensions of the support arms and being engaged on top and bottom thereof by projections formed by mouthshaped recesses.

In accordance with an added feature of the invention, the coupling rods pass through the consoles and the support arms thereof axially parallel to and above a line of the supporting extensions of the respective turbine mount in coupling channels, and the lug arms have ends which are, respectively, positively coupled above the mouthshaped recesses thereof with the ends of the coupling rods.

In accordance with yet another feature of the invention, the support arms with the coupling channels thereof and coupling rods lead through an opening formed in the end wall of the respectively adjacent outer housing with clearance, the clearance forming an annular gap for accommodating the diaphragm seal therein.

In accordance with yet a further feature of the invention, the support arm is formed with an annular shoulder at an end of the support arm facing towards the lug arm, the inner ring flange of the diaphragm seal being fastened sealingly to the annular shoulder, and the outer ring flange of the diaphragm seal being fastened sealingly to the inside of the outer housing end wall at a rim of an opening formed therein.

In accordance with yet an additional feature of the invention, the diaphragm seal is constructed as a corrugated tube or bellows with a double wall flexible in axial direction and also deformable within limits in axially-normal direction.

In accordance with yet an additional feature of the invention, the support and lug arms have circular or elliptical basic cross sections.

In accordance with yet an added feature of the invention, the coupling rods have a threaded end screwable into a tapped blind hole formed in the lug arms, the tapped blind hole being formed in an anchoring projection of the mounthshaped recess.

In accordance with yet an alternate feature of the invention, the coupling rods are length-variable by means of turnbuckles the coupling channel is expanded in a vicinity of the mount housing consoles which is accessible from above to form a turnbuckle chamber sealable vacuumtightly by a sealing cover.

In accordance with a further feature of the invention, there is provided, a turboset with a high-pressure and a low-pressure turbine stage, wherein the first and the second reference planes $(y\text{-}z)_0$, $(y\text{-}z)_1$ normal to the axis are disposed in the turbine mount between the high-pressure and the low-pressure turbine stages, support lug pairs of the high-pressure and the low-pressure turbine stages being mounted in the last-mentioned turbine mount in vicinity of the horizontal axial planes thereof so as to be axially fixed yet horizontally and radially-centrically heat movable, the high-pressure and low-pressure turbine stages being mounted at the ends thereof disposed away from the last-mentioned turbine mount by means of other support lug pairs in appertaining turbine mounts so as to be axially and radially-centrically heat-movable, and the housing of the medium-pressure turbine stage being provided, on a side thereof facing towards the adjacent low-pressure turbine stage, with anchoring points for the coupling rods coupled to the inner housing of the adjacent low-pressure turbine.

In accordance with still another mode of the invention, the housing of the medium-pressure turbine stage has two exhaust steam unions extending laterally outwardly below the horizontal axial plane (x-y), comprising anchoring points disposed on extensions of the exhaust steam unions extending in line with the coupling rods and the lug arms of the inner housing of the adjacent low-pressure turbine stage and symmetrically on both sides of the vertical axial plane (x-y) and, towards a side of the medium-pressure turbine stage, a sealing sleeve sealing the coupling channel of the coupling rods, the sealing sleeve enclosing an end of the coupling rods protruding out of the coupling channel and being fastened sealingly at one of its ends to a rim of an opening formed in the coupling channel and at its other end to an annular collar surrounding the respective anchoring point at the respective extension.

In accordance with still a further mode of the invention there is provided, centering guiding means of the inner housing of the low-pressure turbine stage in the vertical axial plane (x-y) in a lower area of a discharge cross section thereof, axial guide bolts being connected to a supporting grid construction of the inner housing, and guide rods anchored in the turbine foundation, one of the guide rods, respectively, passing through a respective adjacent outer housing end wall with clearance, the clearance forming an annular gap serving to accommodate another sealing diaphragm which surrounds the guide rod concentrically and is connected vacuumtightly to the outer housing, on the one hand, and to the guide rod, on the other hand, the other sealing diaphragm having a construction and mode of fastening identical to that of the first-mentioned sealing diaphragm, an inner ring flange of the other sealing diaphragm being connected vacuumtightly to an annular shoulder of the guide rod, and an outer ring flange of the other sealing diaphragm being connected vacuumtightly to an annular seating surface on the inside of an outer housing end wall.

In accordance with still an additional feature of the invention, for mounting the lug arms of an inner housing of the low-pressure turbine stage on the corresponding support arms of the mount housing consoles without transmission of thrust and, therefore, without coupling rods, the outer housing leadthrough disposed at a downstream outer side of a low-pressure turbine stage, is sealed by means of a sealing diaphragm having the same construction and fastened in the same manner as the first-mentioned sealing diaphragm in vicinity of the combined thrust transmitting coupling rod and support arm leadthrough.

In accordance with still an added feature of the invention, the low-pressure turbine stage is a single stage.

In accordance with again another mode of the invention, the low-pressure turbine stage is a final stage in line axially, and an arrangement having more than a double flow is involved.

In accordance with a concomitant feature of the invention, for mounting the lug arms of an inner housing of the low-pressure turbine stage on the corresponding support arms of the mount housing consoles without transmission of thrust and, therefore without coupling rods, the outer housing lead through disposed within the turbine mount located between the low-pressure turbine stage and the higher-pressure turbine stage adjacent thereto is sealed by means of a sealing diaphragm having the same construction and fastened in the same manner as the first-mentioned sealing diaphragm in vicinity of the combined thrust transmitting coupling rod and support arm leadthrough, when the second axially-normal reference plane $(y\text{-}z)_1$ defining the fixed point of the axial housing expansion is provided.

Other features which are considered as characteristic for the invention are set forth in the appended claims.

Although the invention is illustrated and described herein as embodied in turboset with at least one low-pressure turbine stage having an outer housing and an inner housing coaxial thereto, and with high-pressure and/or medium-pressure turbine stage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figures 1, 1A:
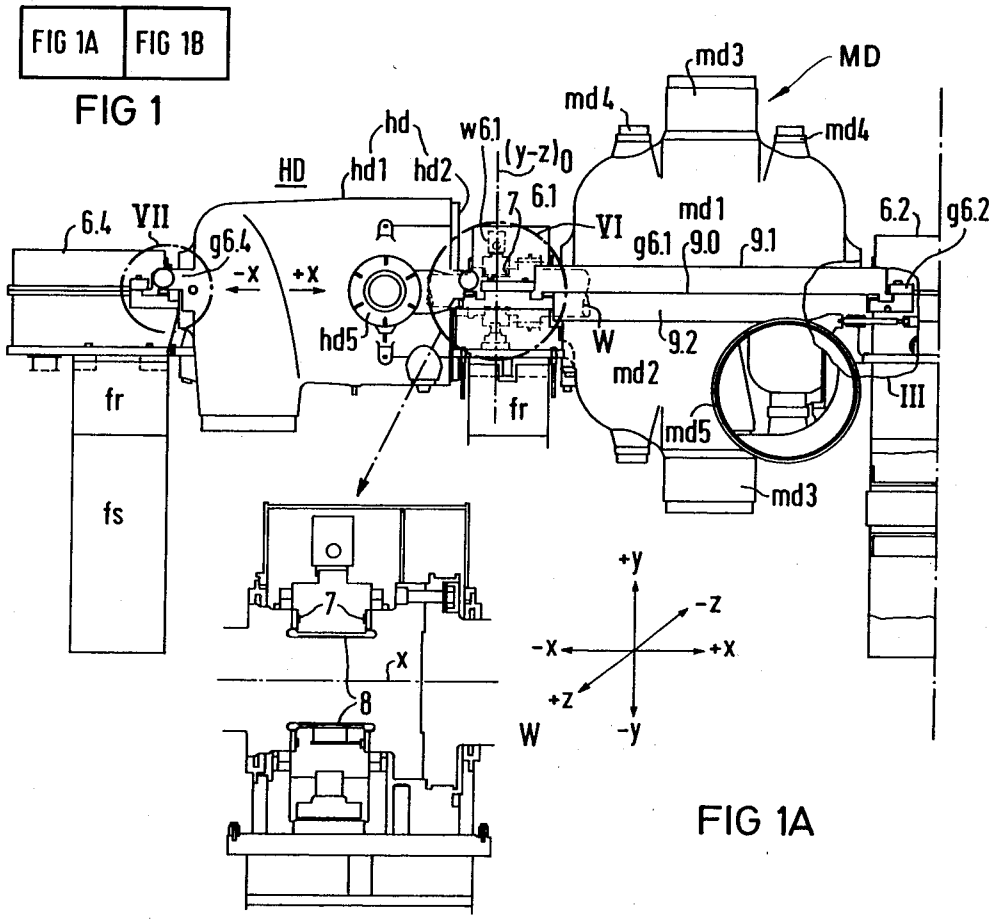
FIG. 1 is a legand showing the relationship of FIGS. 1A and 1B.
FIGS. 1A and 1B are left-hand and right-hand halves of an elevational view of a turboset constructed in accordance with the invention, with high-pressure and medium-pressure turbine stages and two low-pressure turbine stages adjacent thereto.
Figure 1B:
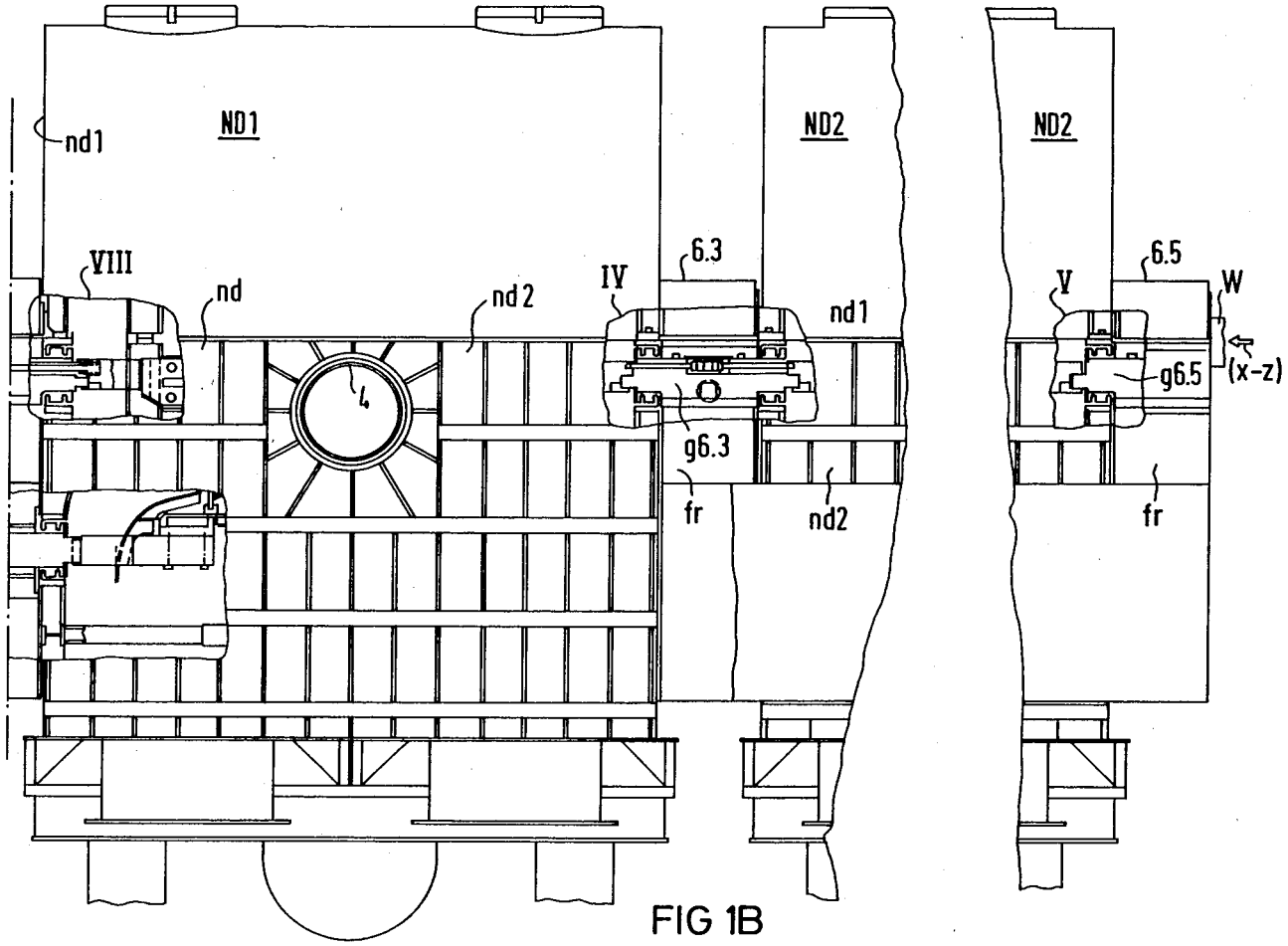
Figure 10:
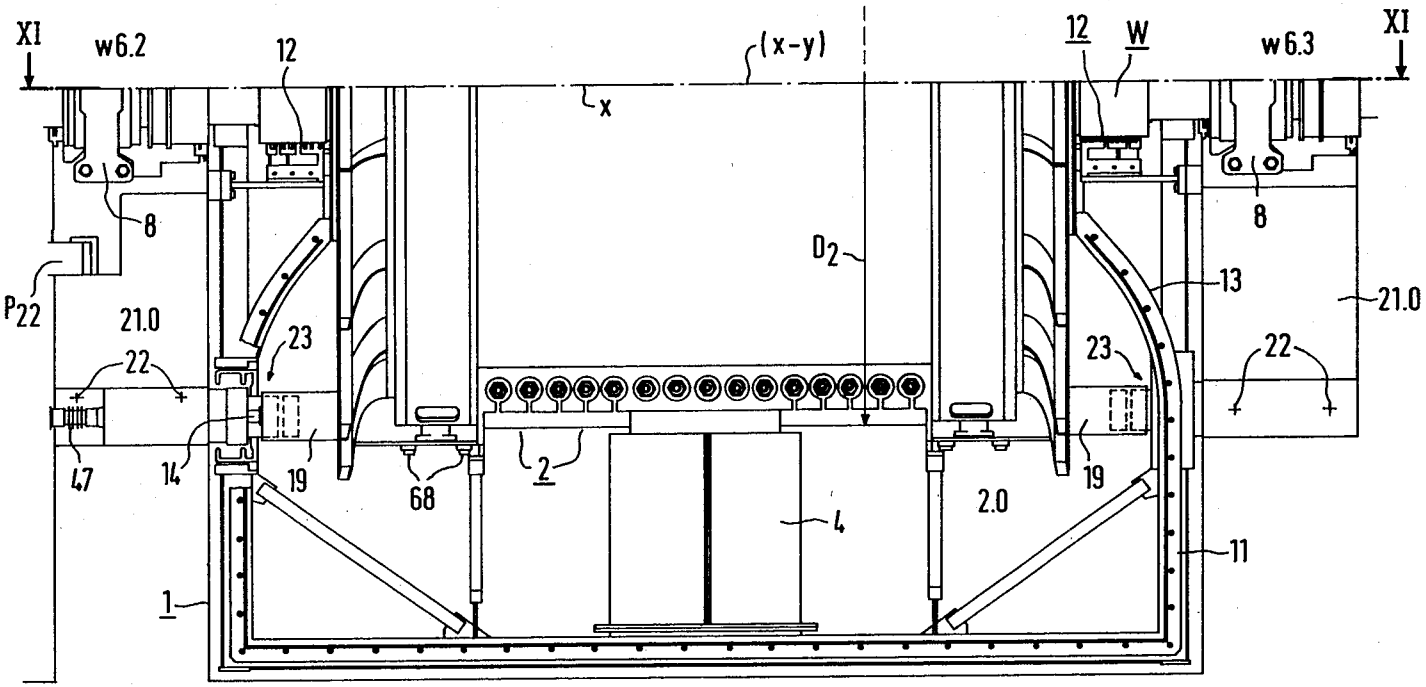
Figure 11A:
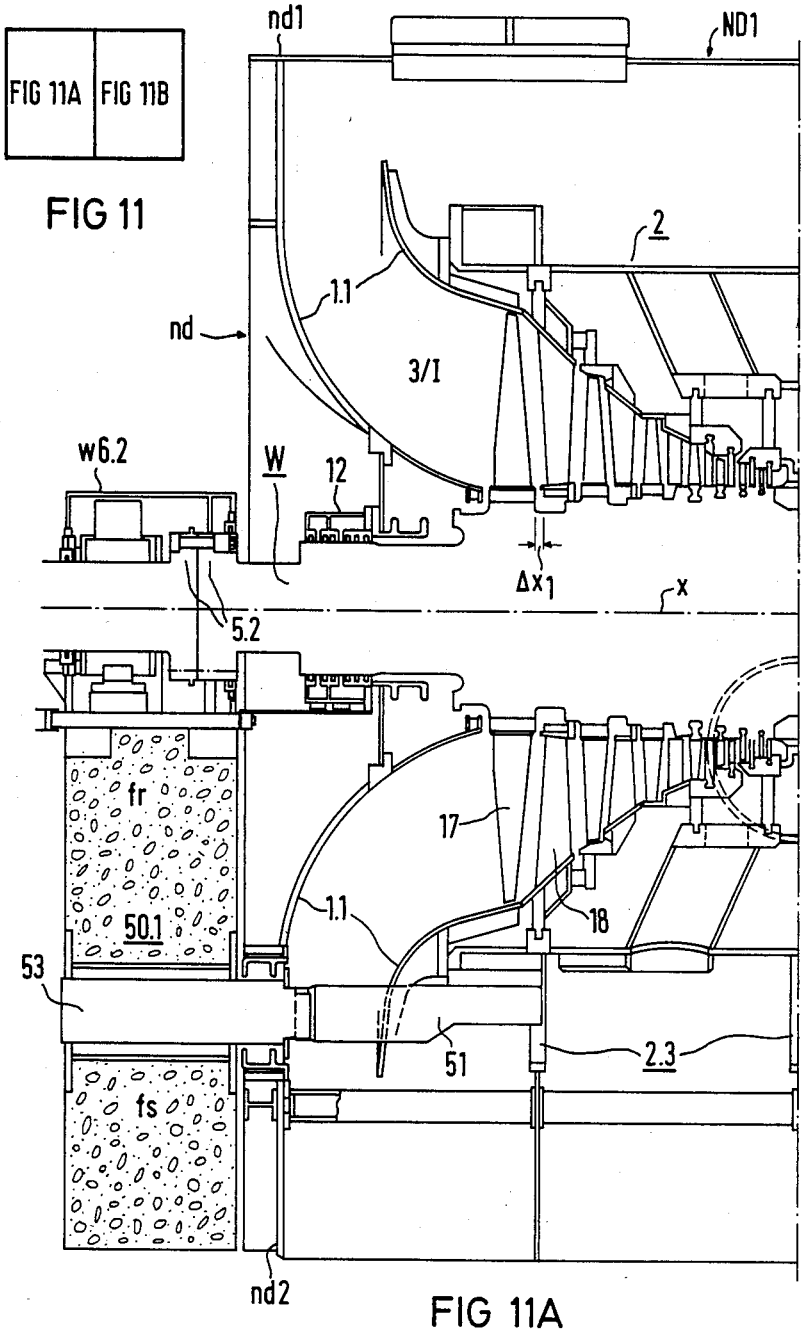
Figure 11B:
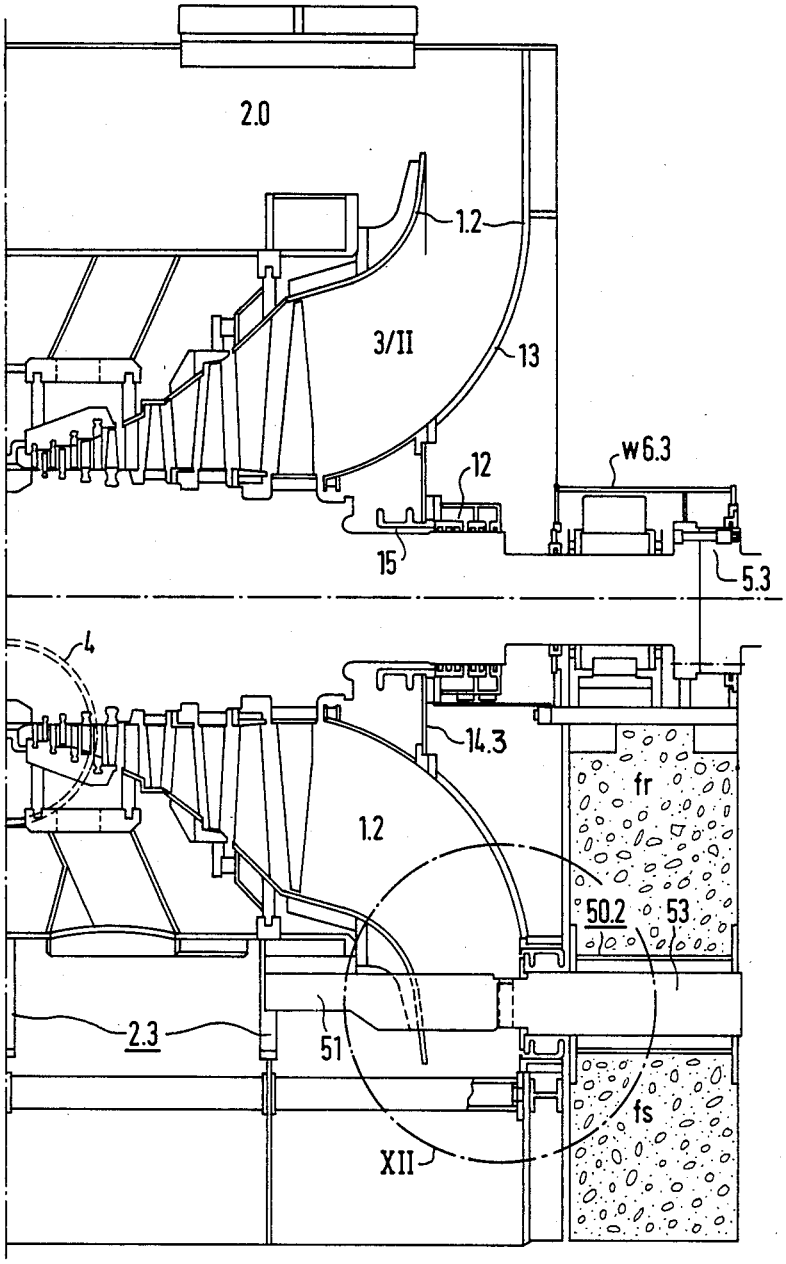

FIG. 10 is a fragmentary sectional view of FIGS. 1A and 1B taken along a plane parallel to that of the drawing of FIGS. 1A and 1B and the inner housing of the low-pressure turbine stage, supplemented by a view of the surrounding outer housing, with the outer housing cover removed, and supplemented by a partial view of the two adjacent turbine mounts, only one turbine stage half being shown because the non-illustrated half is symmetrical thereto;

FIG. 11 is a legand showing the relationship of FIGS. 11A and 11B.

Figure 12:
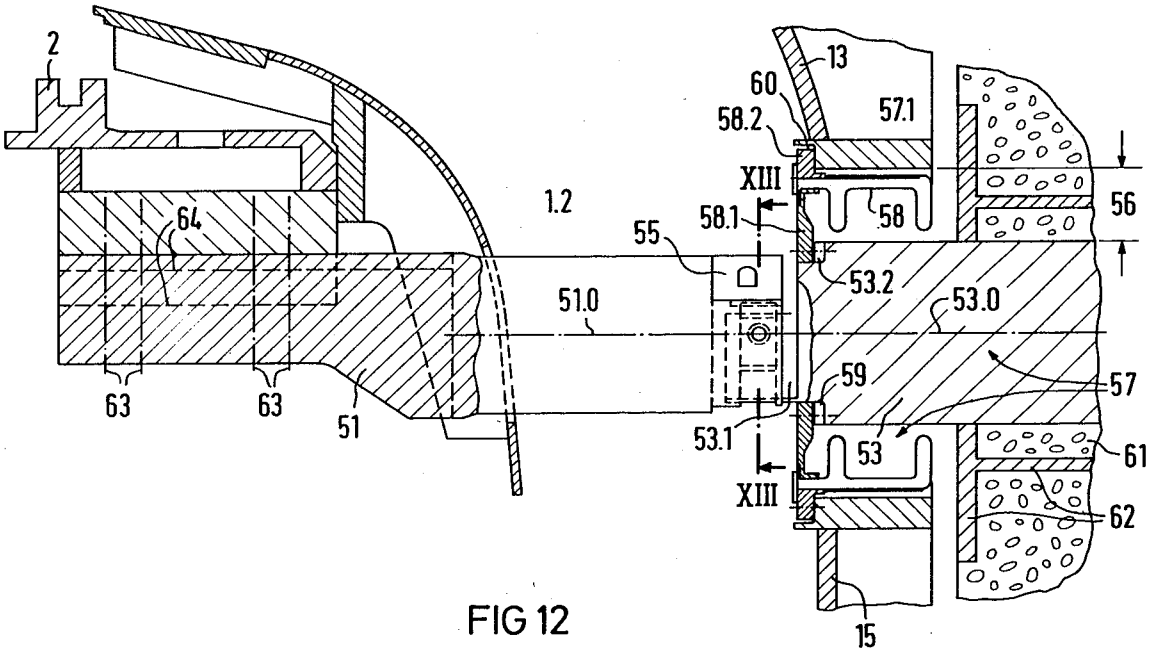
Figure 13:
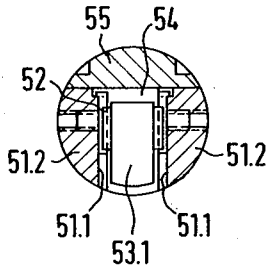
Figure 14:
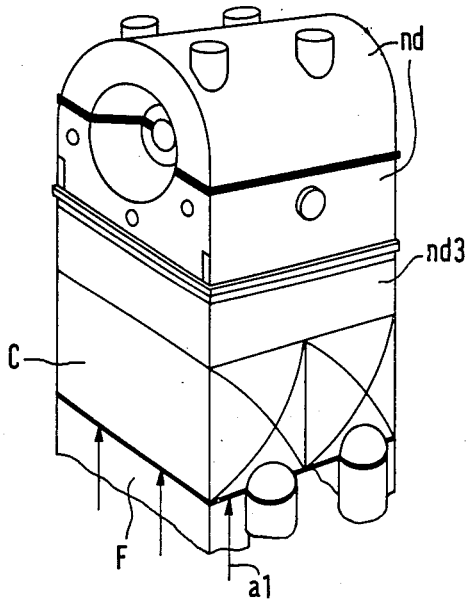
Figure 15:
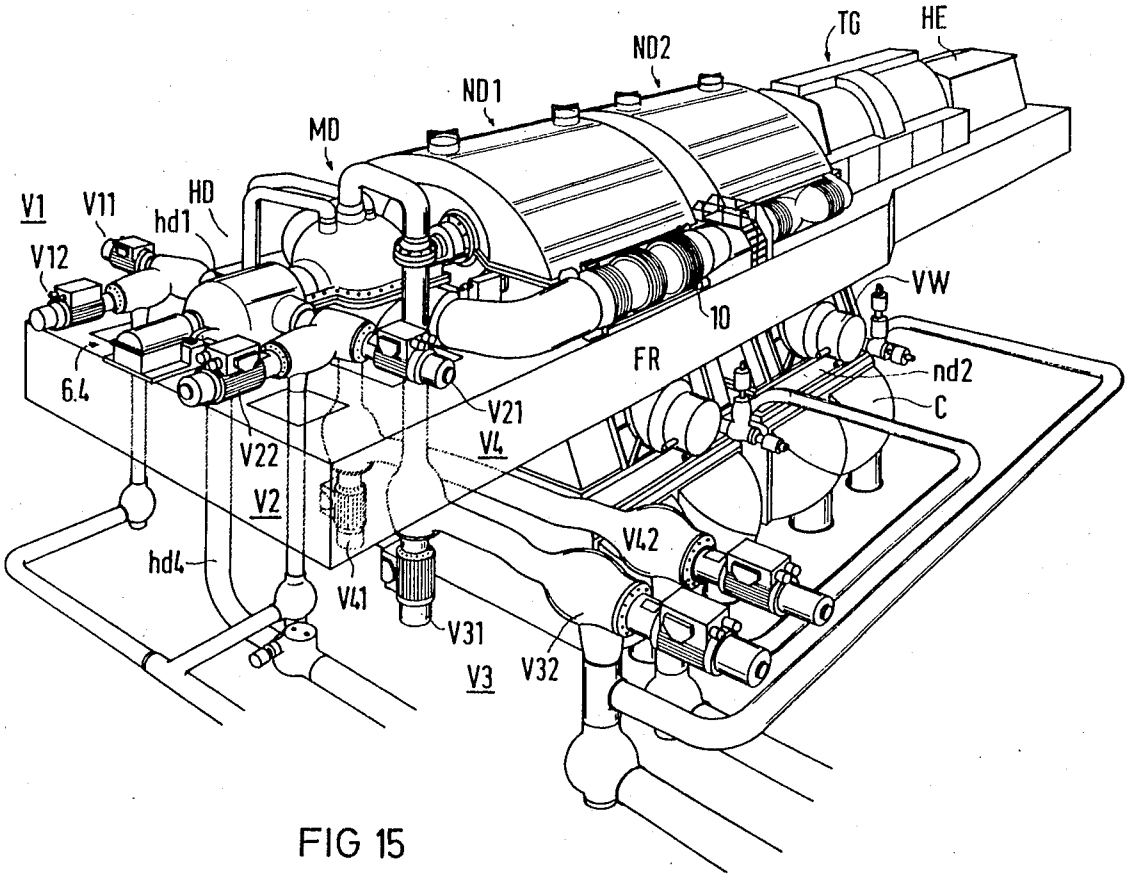

FIGS. 11A and 11B are respective sectional views taken along the line XI—XI in FIG. 10, but with the outer housing cover in place and showing in two halves a single low-pressure turbine stage with its associated shaft bearings, the centering means for the two inner housing ends being shown in the lower half of FIG. 12;

FIG. 12 is an enlarged fragmentary view of FIG. 11B showing the engagement between the turbine mount guide rod and the inner housing guide pin;

FIG. 13 is a sectional view taken along the line XIII—XIII in FIG. 12 i.e. the guiding engagement of the mating surfaces;

FIG. 14 is a front, side and top perspective view of the fastening and mounting of the outer housing of a low-pressure turbine stage, via the exhaust steam nipple or union thereof, directly on the turbine condenser, the reactive mounting forces being indicated by vertical arrows; and FIG. 15 is a front, side and top perspective view of the turboset in its entirety and partly in phantom, with mutually connected steam lines, steam valves and turbogenerator driven by the steam turbine.

Referring now to the drawing and first, particularly, to FIGS. 1A, 1B, 2A and 2B thereof, there is shown a turboset formed of the turbine stages HD, MD, ND1 AND ND2 disposed coaxially with one another in the direction of the shaft center line x. Each of the identically constructed low-pressure turbine stages ND1 and ND2 has an outer housing nd and, as shown in particular in FIGS. 10, 11A and 11B, an inner housing 2 coaxial with the outer housing nd. It is essential for the invention for at least one low-pressure turbine stage to be provided, generally identified by reference characters ND; but as shown, two identical low-pressure turbine stages ND1 and ND2, or more than two, may be provided. Because each one of the low-pressure turbine stages usually has exhaust steam outlets 3/I and 3/II and one common central inlet 4 (for which 2 diametrically opposed pipe nipples or unions are provided), a double-flow type of construction is referred to when one low-pressure turbine stage is involved, and a four-flow type of construction when there are two low-pressure turbine stages.

For the realization of the invention it is furthermore essential that there be provided coaxial with and upstream of the first and only low-pressure turbine stage ND1 and ND, respectively, another high-pressure and/or medium-pressure turbine stage. Shown is a preferred and widely used so-called HMN model with medium-pressure turbine stage MD axially adjacent to the low-pressure turbine stage NDI in $-x$ direction and, furthermore, with a high pressure turbine stage HD, in turn, disposed ahead of and adjacent, respectively, to the medium pressure turbine stage MD axially in $-x$ direction.

The individual shafts of the turbine stages HD, MD, ND1 and ND2 are rigidly coupled to one another to form a shaft line W, details of which are recognizable in FIGS. 10, 11A and 11B, FIGS. 11A and 11B showing particularly clearly the two shaft couplings 5.2 and 5.3 with their tightly joined, unidentified coupling flanges and the two support mounts w6.2 and w.6.3 directly adjacent to the shaft couplings 5.2 and 5.3.

The housings hd, md and nd of the turbine stages HD, MD, ND1 and ND2 and the common shaft line W are mounted on turbine mounts which are generally identified by reference numeral 6 and located in axial interspaces between the individual turbine stages, namely the turbine mounts 6.1, 6.2 and 6.3, or which are located ahead of the high-pressure turbine stage HD or ahead of the second low-pressure turbine stage ND 2 and identified by reference characters 6.4 and 6.5, respectively. The turbine mounts 6.1 through 6.5 are mounted on foundation locks fr of a slab identified as a whole by reference characters FR (note FIGS. 2A and 2B and 15) in the axial interspaces between the turbine stages and at the ends of the latter. These foundation locks fr are generally formed by the webs remaining between the cutouts in the horizontal, prestressed concrete or steel slab FR, through which cutouts the lower housing halves of the turbine stages project, the slab FR supporting the entire turboset except for the outer housing 1 of the low-pressure turbine stages ND and being in turn supported via otherwise non-illustrated foundation supports fs by a base plate resting on a housing foundation F (see FIG. 14), as shown, for example, in FIGS. 1 and 3 of the article "Deformation Behavior of Turbine Foundations" (Journal VGB-Kraftwerkstechnik 59, No. 10 of Oct. 1979, pages 819/33).

The turbine mounts encompass housing mounts, generally identified by reference characters g6.1, g6.2, and so forth in the figures, and particularly in FIGS. 1A, 1B, 2A, 2B, and shaft bearings which would have to be designated w6.1, w6.2, and so forth. These shaft bearings except for the schematically indicated shaft bearing w6.1 with its thrust or axial bearing 7 and its journal box 8, are not shown in FIGS. 1A and 1B, but the two shaft bearings w6.2 and w6.3 with their journal or radial bearings 8, associated with the first low-pressure turbine stage ND1, can be seen in FIGS. 10, 11A and 11B.

The thrust bearing 7 (FIG. 1A) defines a first axially normal reference plane $(y\text{-}z)_0$, from which the axial shaft expansion and shift starts out in $+x$ direction (note the coordinate system shown therewith) and in $-x$ direction. It is essential for the thrust bearing 7 defining the first reference plane normal to the axis to precede the low-pressure turbine stage ND 1 as viewed in $+x$ axial direction and, if a medium-pressure turbine stage MD also is part of the turboset, preferably also to precede this turbine stage axially, as shown. This thrust bearing 7 also preferably defines an axial fixed point for the shaft expansion from which the expansion of the shaft takes its start in $+x$ and $-x$ direction upon heating up. This means that the two shaft shoulders, formed by a shaft constriction, are in engagement with fixed thrust bearing block rings whose blocks are mounted so as to be individually tiltable, resulting in simpler, easily controlled, not otherwise illustrated axial play and axial shaft expansion conditions for the assembly and operation of the turboset. In principle, it is also possible to place the first reference plane normal to the axis into the turbine mount 6.2 between the low-pressure turbine stage ND1 and the adjacent medium-pressure turbine stage MD, in which case this turbine mount 6.2 would have to be equipped with an axial or thrust bearing.

Before explaining in detail how the turboset is mounted, the overall configuration of the turboset will be discussed first with reference to the perspective, phantomlike, overall view according to FIG. 15. Therein can be seen the slab FR and the individual turbine stages HD, MD, ND1, ND2 and also coaxially therewith in outline, the turbogenerator. TG, preceded by the main exciter machine HE, the non-illustrated rotor of the turbogenerator TG being coupled to the shaft line. The high-pressure turbine stage HD has two live steam inlet nipples or unions hd5 which are disposed diametrically opposite one another in a plane transverse to the axis. Connected to the live steam nipples or unions in symmetrical configuration are the two valve combinations V1 and V2, each valve combination being formed of a fast-acting shut-off valve V11, V21 and a regulating valve V12, V22 having a valve axis perpendicular to that of the respective shut-off valve V11, V21.

As FIG. 1A shows, the high-pressure turbine stage HD is of pot-type construction with the actual housing pot hd1 and the cover hd2 tightly joined thereto and sealed, and with the exhaust steam nipple or union hd3 (the exhaust steam line is not shown in FIG. 1A or 1B, but can be seen in FIG. 15 and is identified by reference character hd4 therein).

Also visible in FIG. 15 are the two valve combinations V3 and V4 respectively formed of an intercepting quick-acting shut-off valve V31, V41 and an intercepting regulating valve V32, V42, respectively, the valve axes of the quick-acting shut-off and regulating valves, in turn, being perpendicular to one another. In both FIGS. 15 and 1A, the housing of the medium-pressure turbine stage MD, split in the horizontal axial plane, is identified by the reference character md; also shown in FIGS. 1A and 15 are the upper housing part md1, the lower part md2, sealed, tightly joined housing flanges of upper and lower parts 9.1 and 9.2, live steam inlet nipples or unions for the central intake of this double-flow turbine stage md3 the live steam inlet unions are assigned to a respective upper and lower housing part and are diametrically opposed to one another, nipples or unions for the connection of tap lines md4, the latter being assigned in pairs to the upper and the lower part md1 and md2, respectively.

In FIG. 15, there may further be seen the transfer lines 10 coming from the exhaust steam nipples or unions md5 (only one of which is shown) through which the steam is fed to the intake nipples or unions 4 of the two low-pressure turbine stages ND1 and ND2 (note FIG. 1B). Disposed below the two low-pressure turbine stages ND1 and ND2 and below the slab FR is the steam condenser C with the two feedwater preheaters VW assigned to a respective one of the exhaust steam nipples or unions of the low-pressure turbine stages and constructed as plug-in preheaters.

In the horizontal axial plane x-z, the outer housing of the low-pressure turbine stage is divided into a hood-shaped upper part nd1 having a cross section in the form of a circular segment, and into a box-shaped lower part nd2 of frame construction, the upper and lower parts being joined vacuumtightly by a substantially rectangular parting line flange 11. Both, the upper and the lower parts nd1 and nd2, are tapered inwardly in the area of the two leadthroughs of the line of shafts W so that space is provided for shaft sealing assemblies 12, compare FIGS. 11A, 11B and 12, in which the tapered sections are designated identified by reference numeral 13. At the inner periphery of the conical constrictions 13, at about half to two thirds of the length thereof (as viewed from the outside), an axially normal, flexible sealing wall 14.3, respectively, is fastened and is passed-through with clearance by the shaft line W, the wall 14.3, in the area of the inner edge thereof, being connected to the one annular flange of a sealing diaphragm 15 formed as flexible bellows, the other annular flange of which being connected sealingly to an annular wall of the seal assembly 12 so that, accordingly, the conical constrictions 13, each of which form the outside wall of discharge diffusers 1.1 and 1.2 of the two steam outlets 3/I and 3/II, can "breathe" together with the other components of the outer housing i.e. move and shift relative to the shaft and the shaft line W, respectively, and relative to the seal assembly 12 as a function of temperature and pressure, respectively, without any development of uncontrolled forces due to prevented heat expansions which could hinder the sealing function of the shaft sealing assemblies 12.

As FIGS. 1A and 1B in conjunction with FIGS. 14 and 15 shows, the outer housing nd of the low-pressure turbine stages is connected at a lower, rectangular flange to the exhaust steam nipple or union nd3, and the latter in turn to the steam condenser C which, as indicated by the bearing force arrows a1, rests on the building foundation F. Accordingly, the slab FR (FIG. 15) is relieved of the weight of the outer housings nd of the low-pressure turbine stages ND1 and ND2.

In contrast with the outer housing nd of the low-pressure turbine stages, the inner housing 2 thereof is mounted so as to be radially centered, heat-movable and axially shiftable independently of and relative to the outer housing and (note, in particular, FIGS. 2A, 2B, 3 and 4) coupled to the axially movable end of an axially adjacent turbine stage housing md by means of thrust transmitting coupling rods 14 led heat-movably and vacuumtightly through an end-face wall 15 of the outer housing by means of sealing elements 16 which also make a limited transverse motion possible. The part omitted from FIG. 3 must be imagined in this connection as shown in the right-hand portion of FIG. 4 and detailed in an enlarged view in FIG. 8, respectively.

Figures 2, 2A:
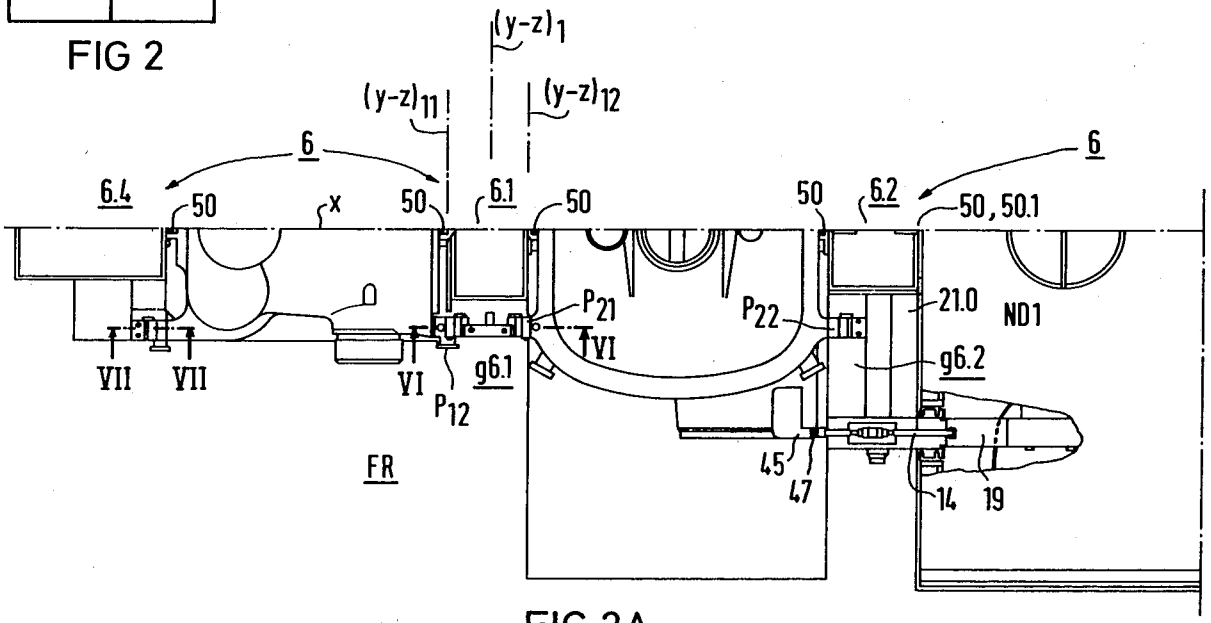
FIG. 2 is a legand showing the relationship of FIGS. 2A and 2B.
FIGS. 2A and 2B are respective plan views of FIGS. 1A and 1B, showing only half of the turboset located on one side of the shaft center line, the non-illustrated half thereof being of identical construction.
Figure 2B:
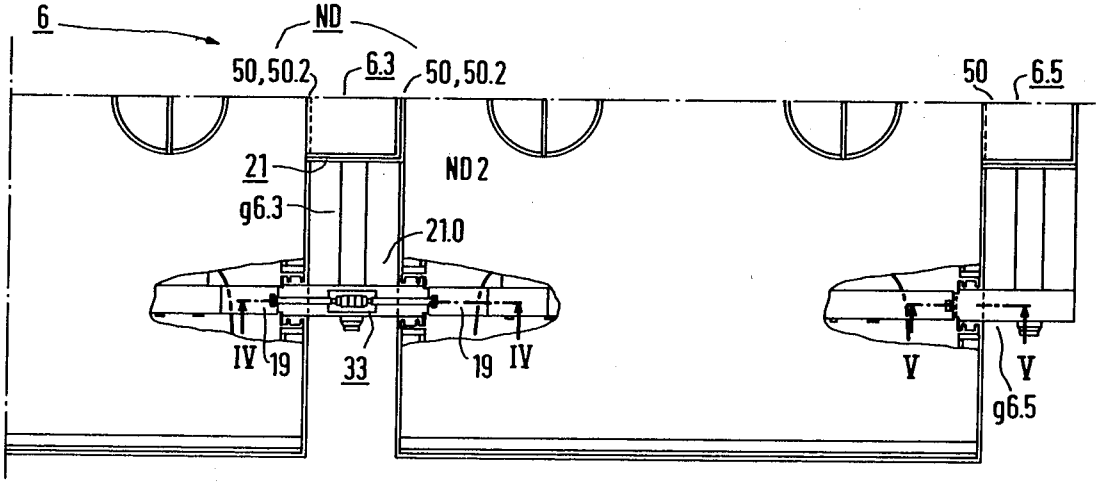
Figure 4:
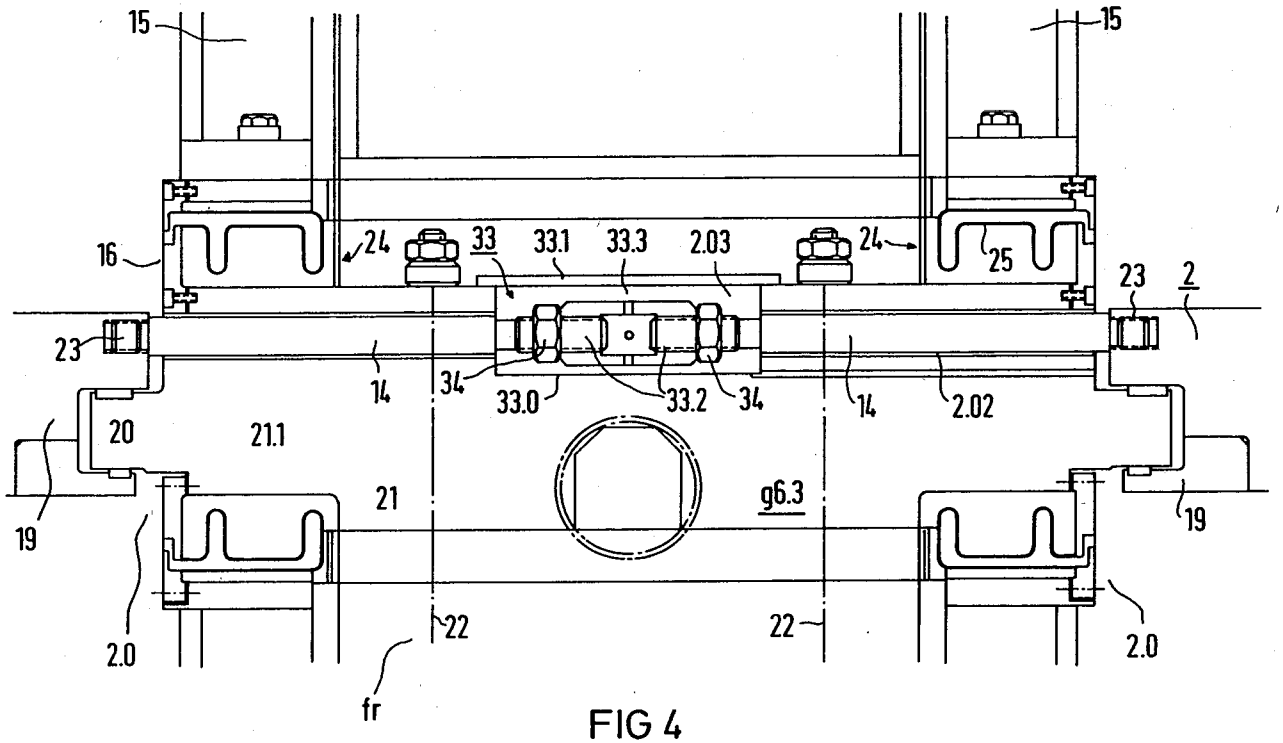
FIG. 4 is an enlarged fragmentary view of FIG. 1B showing the detail IV of the turbine mount between the mutually adjacent low-pressure turbine stages in the vertical plane in which the coupling rod is also disposed.
Figure 5:
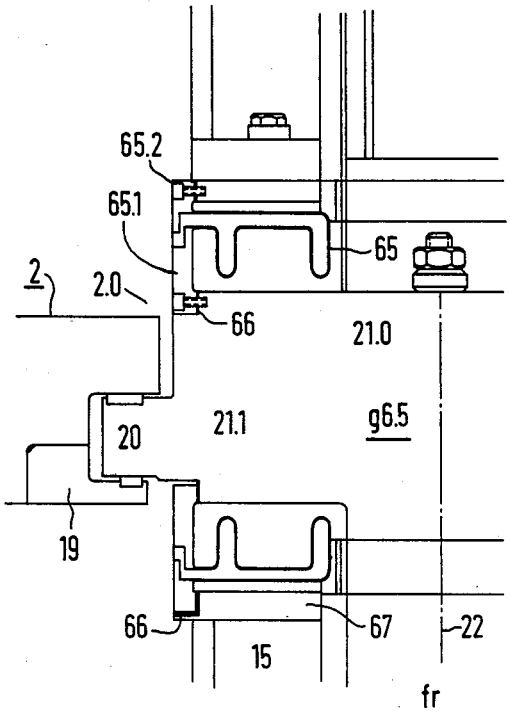
FIG. 5 is an enlarged fragmentary view of FIG. 1B showing the detail V which is a coupling-rodless construction of the turbine mount located at the end of the second low-pressure turbine stage.
Figure 6:
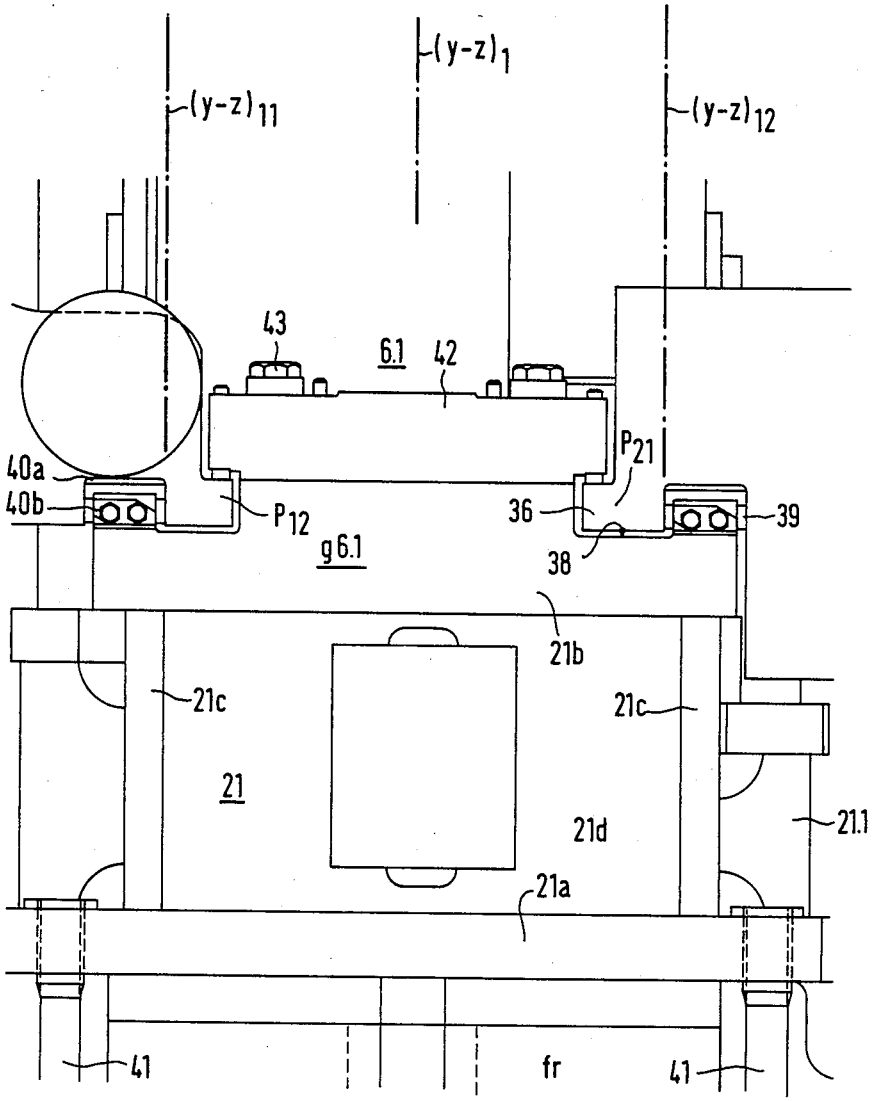
FIG. 6 is an enlarged fragmentary view of FIG. 1A showing the detail VI of the turbine mount between the high-pressure and medium-pressure turbine stages, defining the axial fixed points for the housing and shaft expansion.
Figure 7:
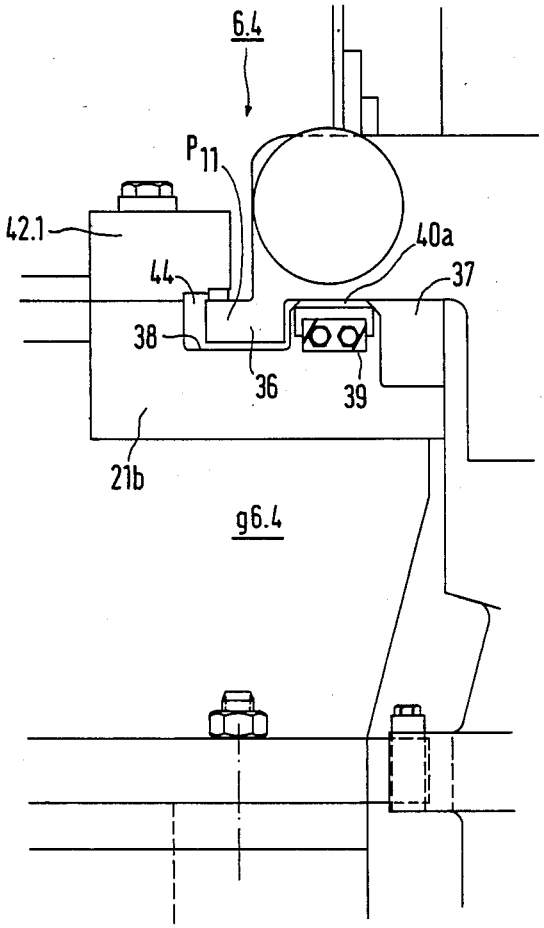
FIG. 7 is an enlarged fragmentary view of FIG. 1A showing the detail VII of the head turbine mount of the high-pressure turbine stage permitting the housing to shift axially, the same as the turbine mount of FIG. 3.

A comparison of FIGS. 2A and 2B with FIGS. 3 through 7 will establish that the turbine mount 6.1 between the two turbine stages HD and MD i.e. the housing mount g6.1 thereof, defines second normal-to-the-axis reference planes $(y\text{-}z)_{11}$, $(y\text{-}z)_{12}$, from which the axial expansion and shift of the turbine stage housing md mounted in this turbine mount g6.1 takes its start in $+x$ direction, starting from the reference plane $(y\text{-}z)_{12}$, and with the turbine stage housing md the inner housings 2 of the low-pressure turbine stages ND1 and ND2, coupled to the turbine stage housing md by the coupling rods 14, shift and expand separately. This becomes clear when studying FIGS. 3 to 5 in conjunction with FIGS. 2A and 2B. in the $-x$ direction, the axial expansion and shift for the housing hd of the high-pressure turbine stage HD mounted in the area of the housing mount g6.1 takes its start from the reference plant $(y-x)_{11}$ normal to the axis, and the end of the housing hd of the high-pressure turbine stage HD, shown on the left-hand side in FIGS. 1A and 2A, can expand, axially guided in $-x$ direction, within the housing mount g6.4 (note FIG. 7). Simplifying, the two normal-to-the axis reference planes of the second type, namely $(y-x)_{11}$ and $(y\text{-}z)_{12}$, can be combined into a second normal-to-the-axis reference plane $(y-x)_1$ as illustrated in FIGS. 2A and 6, in order to demonstrate that, for all practical purposes, this second resulting normal-to-the-axis reference plane coincides with the first normal-to-the-axis reference plane $(y\text{-}z)_0$ for the axial shaft expansion. For this reason, starting from the first and the second normal-to-the-axis reference plane as fixed point, the shaft line W and the line of housings md-nd-rd expand in +x direction in the same sense and, naturally, also in −x direction in the same sense, but here the expansion length is considerably shorter because only the high-pressure turbine stage HD with the housing hd thereof and with the associated shaft section thereof is affected. In summary, this housing and shaft mounting principle has the advantage that the shaft and housing shift takes place practically over the same axial expansion length and in the same direction +x or −x while achieving minimum axial plays between mutually adjacent rotor blade and vane rings. The latter may be seen in FIGS. 11A and 11B and are identified by reference numerals 17 (rotor blade ring) and 18 (vane ring) therein by way of example for the last blade stage. The axial play between these two blade rings is identified as $\Delta x_1$.

According to the invention, the aforedescribed thrust transmission by means of the coupling rods 14 is then placed into the area of thrust-transmitting turbine mounts g6.2 and g6.3 (note, in particular, FIGS. 3, 4, 8 and 9). The vacuumtightly leadthrough of the coupling rods 14 is structurally combined. there with a horizontal, heat-movable lug mounting of the inner housing 2 of the low-pressure turbine stages ND1 and ND2 on lug arms 19 (note also FIGS. 2B and 10). It will be seen from the aforementioned figures that the lug arms 19 of the inner housing 2 extend parallel to the shaft center line direction i.e. parallel to the x direction, and that sliding support and guide surfaces 19.1 and 19.2 are mounted and guided on the corresponding countersurfaces 20.1 and 20.2 of stationary mounts of the associated mount housing 21.

Towards this end, the mount housings 21 (note, in particular, FIGS. 2A, 2B, 4, 5, and 8 to 10) are formed by fixed consoles 21.0 of the mount housings 21 anchored in foundation locks fr, the anchor bolts thereof being identified by reference numeral 22.

In the area of the aforementioned thrust transmitting turbine mounts 6.2, 6.3 and housing mounts g6.2, g6.3, respectively, the coupling rods 14 are positively coupled to the lug arms 19 note coupling points 23. The leadthroughs trough the affected end-face walls 15 of the outer housings nd, generally identified by reference numeral 24, for the positive connection coupling rod 14 and lug arm 19, on the one hand, and for the mounting engagement of the lug arm 19 with the support and guide surface 20.1, 20.2 of the fixed mounts, on the other hand, are respectively disposed in one common vacuum chamber which communicates with the exhaust steam space 2.0 (note FIGS. 10, 11A and 11B) of the respective low-pressure turbine stage ND 1 and ND2 and which is sealed against the outside by diaphragm seals 16 (note, in particular, FIGS. 4 and 8).

As may be seen in the cross-sectional view, the diaphragm seal 16 is constructed as expansion bellows with a double wall 16.1 (outside wall) and 16.2 (inside wall) fexible in axial direction x and also deformable within limits in the direction normal to the axis (any direction in the y-x plane). The inside wall 16.2 has two expansion folds 25, one each at either end of the inside wall 16.2. The outside wall 16.1 may be less flexible and, therefore, has somewhat greater wall thickness. Outside and inside walls 16.1 and 16.2 of the sealing draphragm 16 are equipped with a respective annular flange 26.1, 26.2. The outer annular flange 26.1 of the sealing diaphragm 16 is screwed vacuumtightly to a face 15.1 of the outer housing end-face wall 15, namely to the inside of the latter, and the inner annular flange 26.2 of the sealing diaphragm 16 is screwed vacuumtightly to an annular shoulder 27 of the axially offset support arm 21.1 of the mount housing console 21. In other words, the pairs of annular seats are formed, namely 26.1/15.1 having thightening screws identified by reference numeral 28. Sealing may be accomplished by close metallic contact or by gaskets between the non-illustrated annular seats which are pressed together; these gaskets may be formed of plastically deformable metal, the material known by the trade name Klingerit or plastic resistant to aging and heat. The outer parts of the sealing diaphragm wall 16.1, 16.2 are stressed by the external pressure while the interior 2.01 thereof communicates with the vacuum chamber or exhaust steam space 2.0 of the associated low-pressure turbine stage. Among the other stage space communicating with this space 2.0 are the coupling channel 2.02, through which the coupling rod 14 is led, and the turnbuckle chamber 2.03 which will be discussed further hereinbelow (FIG. 4).

Figure 8:
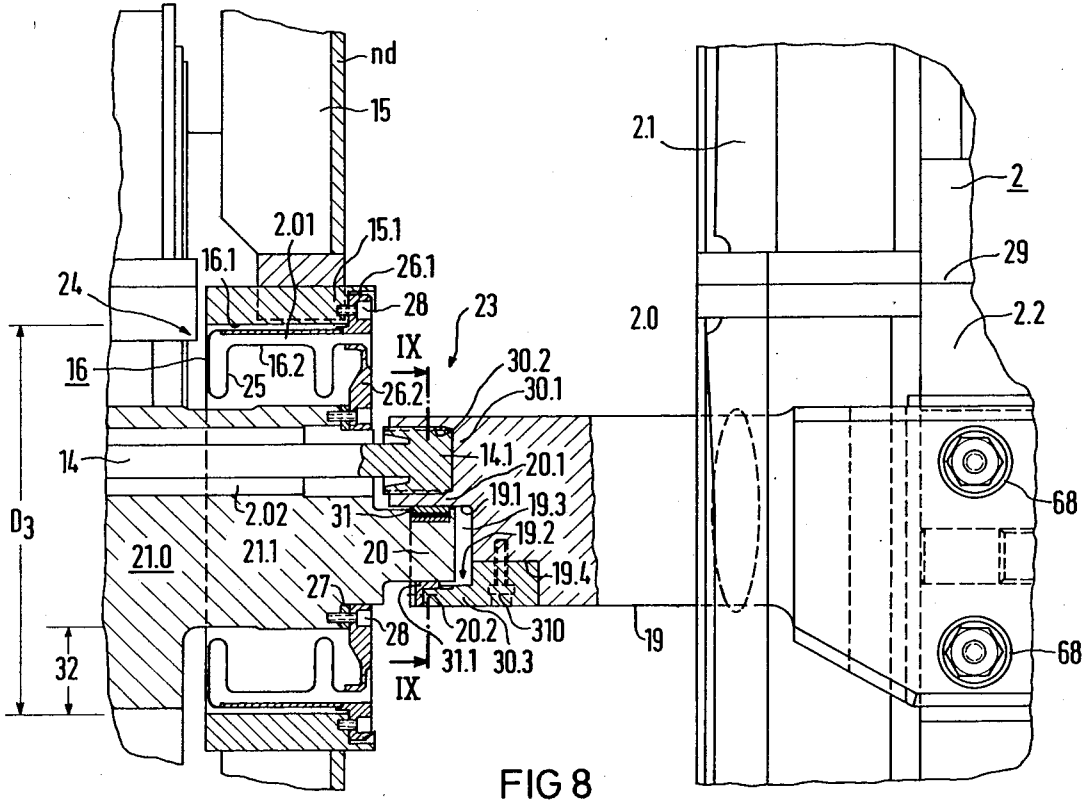
FIG. 8 is an enlarged fragmentary view of FIG. 1B showing which is a leadthrough or coupling rod and support arm through a face wall of the outer housing and the attachment of coupling rod and support arm to the lug arm of the inner housing.

It is evident from FIG. 8 in conjunction with FIG. 10 that the inner housing 2 of the low-pressure turbine stages ND is split axially, namely in the axial parting line 29 which coincides with the horizontal axial plane x-z of the turboset. The upper part is identified by reference character 2.1, the lower part by 2.2. The latter has at both its ends a respective pair of lug arms 19 which have been mentioned hereinbefore. They project out on both sides of the vertical axial plane x-y, symmetrically and in the direction parallel to the shaft center line, and are disposed in the area of or just below the axial parting line 29 and, hence, in or near the area of the greatest inner housing diameter $D_2$.

FIGS. 4, 5 and 8 show in a side view, and FIG. 10 in a top view, that support arms 21.1 extend from the consoles 21.0 of the mount housings 21 in pairs, symmetrically on each face of the mount housings 21, and in line with the lug arms 19 towards the latter through the respective outer housing end-face wall 15, and are engaged at sliding support and guide surfaces 20.1 and 20.2 provided on the top and bottom sides of the support lugs 20 of the support arms 21.1 by projections 30.1 (upper projection) and 30.2 (lower projection) formed by open mouthshaped recesses 19.3 of the lug arm ends on top and bottom. The upper projection 30.1 has at the underside thereof the aforementioned support and guide surfaces 20.1, the lower projection 30.2 has at the top side thereof the support and guide surface 19.2. The lower projection 30.2 is constructed in the form of an angular insert fitted into a corresponding angular recess 19.4 on the underside of the support arm 19 and fastened therein by bolts, in particular, expansion bolts 31. Because the lower projection 30.2 of the support arm 19 performs no supporting, but only a guiding function, this is permissible and logical. To the support and guide surfaces, there also belong adjustment and slide shims, generally identified by reference numeral 32, which are inserted between the top side of the support lug 20 and the underside 19.1 of the upper projection 30.1 and between the top side of the lower projection 30.2 of the support arm 19 and the underside of the support lug 20, respectively. This sliding fit between the support lugs 20 of the support arms 21.1 and the projections 30.1, 30.2 of the lug arms 19 permits a horizontally heat-movable guidance of the inner housing 2 along the support arms 21.1 i.e. a sliding motion in axial direction x and in a plane running plane-parallel to the horizontal axis plane x-z when, due to heating up, the inner housing 2 expands radially-centered heat-movably or correspondingly shrinks upon cooling.

Figure 3:
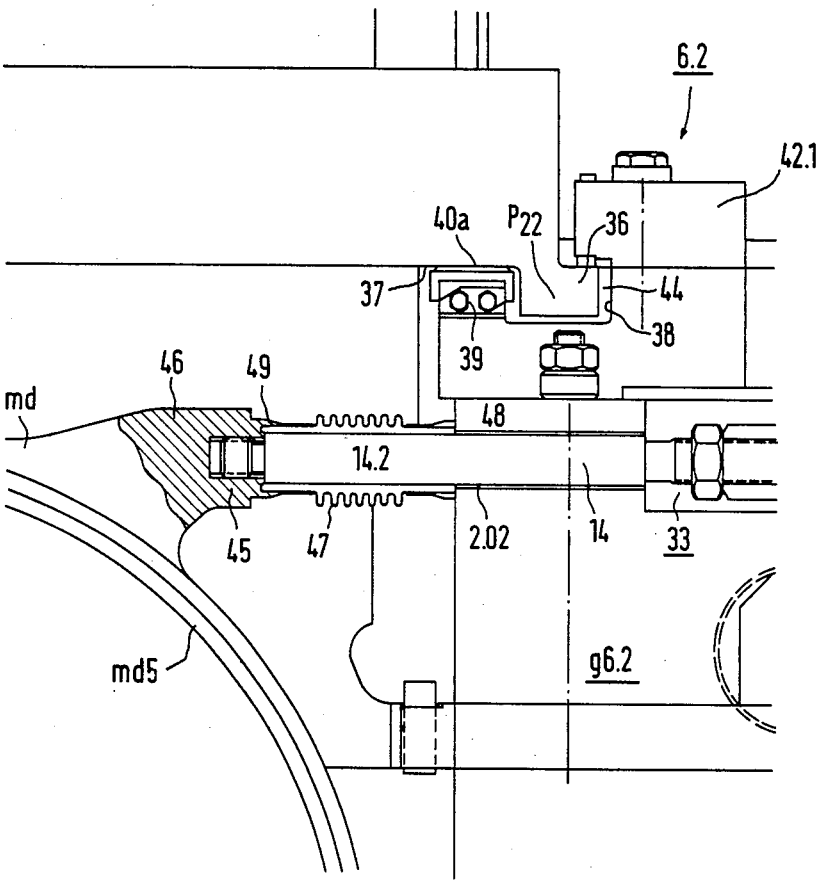
FIG. 3 is an enlarged fragmentary view of FIG. 1A showing the detail III of the turbine mount disposed between the medium-pressure and the first low-pressure turbine stages.

It is also evident, in particular from FIGS. 4 and 8, that the coupling rods 14, in the aforementioned coupling channels 2.02, pass through the consoles 21.0 and their support arms 21.1 axially parallel to and above the line of support lugs 20 of the respective turbine mount 6.2 or 6.3, and that the respective lug arm end i.e. the projection 30.1 thereof, is positively coupled to the respective end of the coupling rod 14 above the mouth-shaped recess 19.3. One advantageous construction results from screwing a threaded end 14.1 of the coupling rods 14 into a tapped blind hole 30.2 of the projection 30.1 of the lug arms 19, the tapped blind hole, as is apparent, being provided above the mouthshaped recess 19.3 in the projection 30.1 serving as anchoring projection. The coupling rod construction shown in FIG. 8 has a strengthened head for the threaded end 14.1, this head being filleted towards the shaft side of the coupling rod 14, thereby achieving a thread of uniform strength, the external thread turns thereof carrying by and large the same load. In FIGS. 3 and 4, on the other hand, a simpler embodiment of the coupling rod 14 is shown having a shaft which is even somewhat larger in diameter than the head 14.1 thereof.

It may be seen from FIGS. 4, 5, 8 and 10 that the support arms 21.1 with the coupling channels 2.02 thereof and coupling rods 14 are led through a round hole of the inner diameter $D_3$ in the end-face wall 15 of the respectively adjacent outer housing nd with the clearance 32 (corresponding to an annular gap), and that the annular space formed by the clearance 32 serves for accommodating the diaphragm seal 16. This affords good accessibility to this diaphragm seal 16 for assembly or disassembly purposes when the outer housing hood nd1 is not yet attached.

Figure 9:
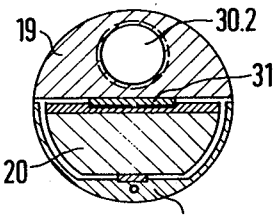
FIG. 9 is a sectional view taken along line IX—IX in FIG. 8.

FIG. 9 shows that the support arms 19 are of circular base cross-section and that, fitting thereon, the support lug 20 forms part of a circular cross-sectional zone. The support arm 21.1 itself is then also of circular base cross-section; this circular base cross-section thereof is led through the center of the essentially hollow-cylindrical diaphragm seal 16. The base cross-section of the lug arm 19 inside the vacuum chamber 2.0 could also be elliptical (even though the circular shape is more advantageous for machining on lathes); it is essential that the circular or elliptical outer contour offers less flow resistance with respect to the steam flow prevailing in the vacuum chamber 2.0.

FIG. 4 and, partly FIG. 3 show that the coupling rods 14 are length-variable by turnbuckles 33 and that the coupling channel 2.02 is expanded in an area of the mount housing consoles 21.0 accessible from above to form the aforementioned turnbuckle chamber 2.03, the latter being closable vacuumtightly by a sealing cover 33.1. The turnbuckle body 33.0 is substantially hollow-cylindrical, having at both its ends a respective thread 33.2, one of which is left-handed, the other right-handed. Disposed crosswise in the center of the turnbuckle body are radial holes 33.3 for the application of tightening tools (e.g. socket wrenches). By turning the turnbuckle body 33.0 in one direction of rotation, the turnbuckle 33 can be loosened, by turning it in the other direction, it can be tightened so that the axial length of th coupling rod assembly formed of the various coupling rod components is variable and adaptable to the installed location of the various turbine stages. One the coupling rod length is properly adjusted, it is fixed by the lock nuts 34. The accessibility of the turnbuckle 33 from above may be seen in FIG. 2B.

As explained hereinbefore in principle, of the turboset shown, the first reference plane $(y\text{-}z)_0$ normal to the axis and the second reference plane $(y\text{-}z)_1$ normal to the axis are placed in the turbine mount 6.1 between high-pressure and medium pressure turbine stages HD and MD. For this purpose, the support lug pairs $P_{12}$ and $P_{21}$, respectively, of the high-pressure and medium-pressure turbine stages HD and MD are mounted in this reference mount 6.1 and in the corresponding housing mount g6.1, respectively in the area of the horizontal axial planes 35.0 (turbine stage HD) and 9.0 (turbine stage MD) thereof so as to be axially fixed, but heat-movable horizontally and radially centered. The horizontal axial planes 35.0 and 9.0 coincide with the entire horizontal axial plane x-z of the turboset. Of the support lug pairs of the turbine stages HD and MD, FIGS. 1A, 2A and 6, respectively, show only the one support lug $P_{12}$ and $P_{21}$, respectively, the respective other lug of the pair should be imagined to be arranged mirror-symmetrically to the vertical axial plane x-y. The special way in which the support lugs of the turbine stages HD, MD are constructed and mounted is described in detail in application Ser. No. 879,131 filed June 26, 1986 simultaneously herewith and assigned to the same corporated assignee as that of the instant application, a description thereof is provided within the instant application only to the extent necessary for understanding the invention. Each one of the support lugs, generally identified by reference character P, respectively, have a blockshaped, stepshaped extension 36 and a stepshaped backoff 37 adjacent thereto and offset upwardly. At the strongly constructed support flange **21*b* thereof on the cover side, the mount housing 21 is provided with a depression 38 for the accommodation of the extension 36 and with a stepshaped, raised rim 39 axially adjacent thereto for engaging in the backoff 37 of the support lug P. Inserted in the gap remaining between the raised rim 39 and the backoff 37 are slide and adjustment shims which fill the vertical gaps which form and are identified by reference character 40*a* and also fill the forming or remaining axial gaps and are identified by reference character 40*b*. The latter are disposed on both sides of the raised rim 39 i.e. on the side thereof facing the +x direction and on the side thereof facing the −x direction, thus fixing axially the respective support lug and the support lug pair $P_{12}$, $P_{21}$, respectively, while the slide and adjustment shims 40*a* serve in providing the height adjustment, in particular, the alignment of the horizontal axial plane of the turbine stages HD or MD to the desired position in coincidence with the entire horizontal axial plane x-z of the turboset. In FIG. 6, reference character 21*a* identifies yet a strong mount housing bottom and anchor plate, respectively, fastened to the foundation lock fr by anchor bolts 41. Mount housing end-face walls 21*c* fact in x direction and are welded in between the support flange 21*b* on the cover side and the anchor plate 21*a*; the end-face wall 21*d* faces the viewer. A safety lock 42 is disposed in pairs per housing mount g6.1 on both sides of the vertical axis plane and serves to secure the support lugs $P_{12}$ and $P_{21}$ of the turbine stages against lifting forces and moments, the lock 42 being screwed to the support flanges 21***b* by strong anchor bolts 43 constructed as expansion bolts.

The high-pressure and medium-pressure turbine stages HD and MD are mounted at the ends thereof away from the reference mount 6.1 in the associated turbine mounts 6.4, 6.2, and housing mounts g6.4, g6.2, respectively, by means of support lug pairs $P_{11}$-$P_{11}$ and $P_{22}$-$P_{22}$, respectively, (here again, only one respective support lug of the support lug pairs is visible) so as to be axially and radially-centered heat-movable. Thereby, the support lugs $P_{11}$, $P_{22}$ have stepshaped extensions 36 and backoffs 37, and the support flanges 21*b* have depressions 38 and raised rims 39; however, the depressions 38 are larger and wider, respectively, so that axial gaps 44 remain for free axial movement of the stepshaped extensions 36 of the support lugs, for which reason the faces of the raised rims 39 facing in +x and in −x direction are also not provided with keys or adjustment shims 40*b*; only the adjustment shims 40*a* needed for height adjustment are inserted. Safety locks 42.1 absorb the lifting forces and moments of the support lugs $P_{11}$, $P_{22}$. The axial extent thereof is less than that of the safety locks 42 because the latter are used for a double housing mount.

As FIG. 3 shows, the axially guided shifting and sliding motion of the housing end of the turbine stage MD facing in x direction is transmitted to the inner housing 2 of the axially adjacent turbine stage ND1 by the first of the coupling rods 14 and a turnbuckle 33. For this purpose, the turbine stage MD i.e. its housing md, is provided with a pair of anchor points, of which one anchor point 45 shown in FIG. 3 can also be seen in FIG. 2A. It is of particular advantage for the construction of the MD turbine stage with two exhaust steam nipples or unions md5 located laterally below the horizontal axial plane 9.0 of the housing md thereof, if the anchoring points 45 are disposed on extension 46 of the exhaust steam nipples or unions md5, the extensions extending in line with the coupling rods 14 and lug arms 19 of the inner housing 2 of the adjacent low-pressure turbine stage ND1 and symmetrically on both sides of the vertical axial plane x-y. The coupling channel 2.02 of the coupling rods 14 is sealed against the medium-pressure turbine stage MD side by a gasket 47 which, as may be seen, surrounds the end 14.2 of the coupling rod 14 projecting out of the coupling channel 2.02, the one end thereof being connected vacuumtightly to the hole rim 48 of the coupling channel 2.02, and the other end thereof to a collar 49 which encloses the anchoring point 45 on the extension 46.

In FIGS. 2A and 2B, there are so-called centering guides 50 for the housing hd, md and nd of the various turbine stages, the task thereof being to keep the individual turbine stage housing in axial alignment relative to one another and coaxial to the shaft center line x, and to guide them when moved by heat. Within the scope of the invention of the instant application, the centering guides for the housing hd and md as well as for the outer housings nd of the low-pressure turbine stages ND1, ND2 will not be gone into in greater detail; the centering guiding system for the housings hd and md has been described in detail in the aforementioned copending application Ser. No. 879,131 which has the same assignee as that of the instant application. Within the scope of the invention, only the centering guiding means 50.1, 50.2, 50.3 (FIGS. 2A, 2B) for the inner housings 2 are of interest because, as regards the configuation and construction of the diaphragm seal, they are similar or identical to those already described in connection with the diaphragm 16. It may be seen from FIGS. 11A and 11B and 12 that there are provided at both ends of the inner housing 2 of the low-pressure stage ND1 and in its lower area where the exhaust sections 3/I and 3/II of the diffusers 1.1 and 1.2 terminate downwardly (this area lies at the same time in the area of the vertical axial plane x-y), axial guide bolts 51 which are connected to the support grid construction 2.3 of the inner housing 2 and whose vertical guide surfaces 51.1 and slide shims 52 fastened thereto (compare the section according to FIG. 13) are in sliding and guiding engagement with the substantially rectangular guide mandrel 53.1 of a guide rod 53 coaxial to the axial guide bolts 51. Within the foundation lock fr (or another suitable foundation structure), the axis 53.0 of the guide rod 53 is aligned exactly with the vertical axial plane x-y and horizontally so as to be axially parallel with the shaft center line x, this axis 53.0 again being in alignment with the axis 51.0 of the respective guide bolt 51 of the inner housing, as FIG. 12 shows. It should be noted, in the case of the centering means 50.2 (note FIG. 2B) that it is a double centering means in which the guide mandrels 53.1 of the guide rod 53 protrude from the foundation lock fr in both direction −x and +x, engaging the recess 54 (note FIG. 13 formed by the forkshaped guide projections 51.2 of the guide bolt 51 and bounded by the plane-parallel keys 51.2 in conjunction with the fitting parts in the form of guide and slide shims 52 (the second mirror-image half of the double centering means 50.2 is not shown in FIG. 12).

The foregoing is a description corresponding, in substance, to German application No. P 35 22 916.0, dated June 27, 1985, International priority of which is being claimed for the instant application, and which is hereby made part of this application. Any material discrepancies between the foregoing specification and the specification of the aforementioned corresponding German application are to be resolved in favor of the latter.

There is claimed:

1. Turboset having at least one low-pressure turbine stage with an outer housing and an inner housing coaxial therewith, and having at least one other turbine stage disposed coaxially with and upstream of the low-pressure turbine stage, the turbine stages having shafts rigidly coupled to one another to form a line of shafts, turbine stages having respective housings which with the shaft line are mounted in turbine mounts formed of housing mounts and shaft bearings, the turbine mounts located between the turbine stages having housing mounts mounted on foundation locks of a turbine foundation in axial interspaces between the turbine stages and at ends of the turbine stages, and other turbine mount with a thrust bearing for the shaft line preceding the low-pressure turbine stage upstream therefrom, the thrust bearing of said other turbine mount defining an axially normal first reference plane $(y\text{-}z)_0$ from which axial shaft expansion and shift begin, the low-pressure turbine stage having an outer housing, and an inner housing mounted so as to be radially-centrically, heat-movable and axially shiftable independently of and relative to the outer housing and being also connected to an axially movable mounted end of an axially adjacent turbine stage housing or turbine mount housing by means of thrust transmitting coupling rods leading heat-movably and vacuumtightly through an end wall of the outer housing by means of sealing elements also permitting limited transverse motion, and one of the turbine mounts preceding the low-pressure turbine stage defining an axially normal second reference plane $(y\text{-}z)_1$ from which axial expansion and shift of the turbine stage housing mounted on the one turbine mount and of the turbine stage housings coupled thereto, including the inner housing or housings of the low-pressure turbine stage or stages, take their start so that the shaft and housing shift takes place over practically the same axial expansion length and in the same direction while achieving minimum axial plays between mutually adjacent rotor blade and vane rings of the respective low-pressure turbine stage, comprising a horizontal, heat-movable lug mounting of the inner housing of the respective low-pressure turbine stage on lug arms structurally combined with the vacuumtight leadthrough of the coupling rods via which the thrust transmission is disposable in vicinity of the thrust transmitting turbine mounts; said lug arms of the inner housing of the respective low-pressure turbine state extending in a direction parallel to the shaft center line, and sliding support and guide surfaces of said lug arms being mounted and guided on fixed bearing surfaces of the associated mount housing; the coupling rods being positively coupled to said lug arms in said vicinity of the thrust transmitting turbine mounts, and the leadthrough through the outer housing of the respective low-pressure turbine stage for the positive-coupled coupling rod to the respective lug arm being disposed on said support and guide surfaces of said fixed bearing surfaces, respectively, in a common vacuum chamber communicating with an exhaust steam chamber of the low-pressure turbine stage and, respectively, sealed from the outside by means of a diaphragm seal, said fixed bearing surfaces being formed by stationary consoles of the mount housings anchored in the foundation locks, support arms of said consoles extending out in line with said lug arms towards said lug arms through the respective outer housing end wall, said support and guide surfaces being disposed on the top and bottom sides of supporting extensions of said support arms and being engaged on top and bottom thereof by projections formed by mouthshaped recesses.

2. Turboset according to claim 1, wherein the coupling rods pass through said consoles and said support arms thereof axially parallel to and above a line of said supporting extensions of the respective turbine mount in coupling channels, and the lug arms have ends which are, respectively, positively coupled above the mouthshaped recesses thereof with the ends of the coupling rods.

3. Turboset according to claim 2, wherein said support arms with said coupling channels thereof and coupling rods lead through an opening formed in the end wall of the respectively adjacent outer housing with clearance, said clearance forming an annular gap for accommodating said diaphragm seal therein.

4. Turboset according to claim 2, wherein said coupling rods have a threaded end screwable into a tapped blind hole formed in said lug arms, said tapped blind hole being formed in an anchoring projection of said mounthshaped recess.

5. Turboset according to claim 2, wherein said coupling rods are length-variable by means of turnbuckles said said coupling channel is expanded in a vicinity of said mount housing consoles which is accessible from above to form a turnbuckle chamber sealable vacuumtightly by a sealing cover.

6. Turboset according to claim 3, wherein said support arm is formed with an annular shoulder at an end of said support arm facing towards the lug arm, said inner ring flange of said diaphragm seal being fastened sealingly to said annular shoulder, and said outer ring flange of said diaphragm seal being fastened sealingly to the inside of the outer housing end wall at a rim of an opening formed therein.

7. Turboset according to claim 1, wherein said diaphragm seal is constructed as a corrugated tube or bellows with a double wall flexible in axial direction and also deformable within limits in axially-normal direction.

8. Turboset according to claim 1, wherein said support and lug arms, respectively, have circular basic cross sections.

9. Turboset according to claim 1 with a high-pressure and a low-pressure turbine stage, wherein said first and said second reference planes $(y\text{-}z)_0$, $(y\text{-}z)_1$ normal to the axis are disposed in the turbine mount between the high-pressure and the low-pressure turbine stages, support lug pairs of the high-pressure and the low-pressure turbine stages being mounted in said turbine mount between the high and the low-pressure turbine stages in the vicinity of the horizontal axial planes thereof so as to be axially fixed yet horizontally and radially-centrically heat movable, the high-pressure and low-pressure turbine stages being mounted at the ends thereof disposed away from said turbine mount between the high and the low-pressure turbine stages by means of other support lug pairs in appertaining turbine mounts so as to be axially and radially-centrically heat-movable, and the housing of the medium-pressure turbine stage being provided, on a side thereof facing towards the adjacent low-pressure turbine stage, with anchoring points for said coupling rods coupled to the inner housing of the adjacent low-pressure turbine.

10. Turboset according to claim 9, wherein the housing of the medium-pressure turbine stage has two exhaust steam unions extending laterally outwardly below the horizontal axial plane (x-y), comprising anchoring points disposed on extensions of said exhaust steam unions extending in line with said coupling rods and said lug arms of the inner housing of the adjacent low-pressure turbine stage and symmetrically on both sides of the vertical axial plane (x-y) and, towards a side of the medium-pressure turbine stage, a sealing sleeve sealing said coupling channel of said coupling rods, said sealing sleeve enclosing an end of said coupling rods protruding out of said coupling channel and being fastened sealingly at one of its ends to a rim of an opening formed in said coupling channel and at its other end to an annular collar surrounding the respective anchoring point at the respective extension.

11. Turboset according to claim 1, comprising centering guiding means of the inner housing of the low-pressure turbine stage in the vertical axial plane (x-y) in a lower area of a discharge cross section thereof, axial guide bolts being connected to a supporting grid construction of the inner housing, and guide rods anchored in the turbine foundation, one of said guide rods, respectively, passing through a respective adjacent outer housing end wall with clearance, the clearance forming an annular gap serving to accommodate a sealing diaphragm which surrounds the guide rod concentrically and is connected vacuumtightly to the outer housing, on the one hand, and to the guide rod, on the other hand, said sealing diaphragm having a construction and mode of fastening identical to that of said diaphragm seal, an inner ring flange of said sealing diaphragm being connected vacuumtightly to an annular shoulder of said guide rod, and an outer ring flange of said sealing diaphragm being connected vacuumtightly to an annular seating surface on the inside of an outer housing end wall.

12. Turboset according to claim 1, wherein, for mounting the lug arms of an inner housing of the low-pressure turbine stage on the corresponding support arms of the mount housing consoles without transmission of thrust and, therefore, without coupling rods, the outer housing leadthrough disposed at a downstream outer side of a low-pressure turbine stage, is sealed by means of a sealing diaphragm in vicinity of the combined thrust transmitting coupling rod and support arm leadthrough.

13. Turboset according to claim 12, wherein the low-pressure turbine stage is a single stage.

14. Turboset according to claim 12, wherein the low-pressure turbine stage is a final stage in line axially, and an arrangement having more than a double flow is involved.

15. Turboset according to claim 1, wherein, for mounting the lug arms of an inner housing of the low-pressure turbine stage on the corresponding support arms of the mount housing consoles without transmission of thrust and, therefore without coupling rods, the outer housing lead-through disposed within the turbine mount located between the low-pressure turbine stage and the higher-pressure turbine stage adjacent thereto is sealed by means of a sealing diaphragm in vicinity of the combined thrust transmitting coupling rod and support arm leadthrough, when the second axially-normal reference plane $(y\text{-}z)_1$ defining the fixed point of the axial housing expansion is provided.

16. Turboset according to claim 1, wherein said support and lug arms, respectively, have elliptical basic cross sections.

17. Turboset according to claim 1, wherein an outer ring flange of said diaphragm seal for the vacuumtight leadthrough is attached vacuumtightly to an end face of the outer housing of the low-pressure turbine stage, and an inner ring flange is attached vacuumtightly to a turbine mount housing part which accommodates in the interior thereof at least most of the respective coupling rod and forms a part of said vacuum chamber.

18. Turboset according to claim 1, wherein the inner housings of the low-pressure turbine stages are split axially and lower parts thereof have at the ends, respectively, two of said lug arms projecting out on both sides of a vertical axial plane (x-y) symmetrically and in a direction parallel to the shaft center line, said lug arms being disposed in vicinity of an axial parting line and in vicinity of the largest inner housing diameter.

* * * * *